US012800199B2

(12) United States Patent
Trevisan et al.

(10) Patent No.: US 12,800,199 B2
(45) Date of Patent: Nov. 17, 2026

(54) HYBRID EVAPORATOR ASSEMBLY

(71) Applicant: MITSUBISHI ELECTRIC HYDRONICS & IT COOLING SYSTEMS S.P.A., Bassano del Grappa (IT)

(72) Inventors: Marco Trevisan, Bassano del Grappa (IT); Federico Dal Farra, Bassano del Grappa (IT)

(73) Assignee: MITSUBISHI ELECTRIC HYDRONICS & IT COOLING SYSTEMS S.P.A., Bassano del Grappa (IT)

( * ) Notice: Subject to any disclaimer, the term of this patent is extended or adjusted under 35 U.S.C. 154(b) by 113 days.

(21) Appl. No.: 18/712,440

(22) PCT Filed: Nov. 23, 2022

(86) PCT No.: PCT/IB2022/061339

§ 371 (c)(1),
(2) Date: May 22, 2024

(87) PCT Pub. No.: WO2023/095023

PCT Pub. Date: Jun. 1, 2023

(65) Prior Publication Data

US 2025/0003650 A1 Jan. 2, 2025

(30) Foreign Application Priority Data

Nov. 26, 2021 (IT) ..... 102021000030026

(51) Int. Cl.
*F25B 39/02* (2006.01)

(52) U.S. Cl.
CPC ..... *F25B 39/02* (2013.01)

(58) Field of Classification Search
CPC ..... F25B 2339/0242; F28D 7/16; F28D 3/04; F28D 2021/0071
See application file for complete search history.

(56) References Cited

U.S. PATENT DOCUMENTS 3,213,935 A 10/1965 Reid, Jr.
5,638,691 A 6/1997 Hartfield et al.
(Continued)

FOREIGN PATENT DOCUMENTS

EP 3748270 A1 12/2020
EP 3748271 A1 12/2020
(Continued)

OTHER PUBLICATIONS

International Search Report and Written Opinion issued in connection with International Patent Application No. PCT/IB2022/061339 and dated Jan. 2, 2023, 11 pages.
(Continued)

*Primary Examiner* — Ana M Vazquez
(74) *Attorney, Agent, or Firm* — KLINTWORTH & ROZENBLAT LLP

(57) ABSTRACT

Evaporator assembly for evaporating a refrigerant fluid of a refrigerant arrangement, said evaporator assembly comprising a housing defining a space extending along a longitudinal axis, the evaporator comprising a hybrid evaporation module housed within the space and comprising a tube bundle provided with a plurality of tubes configured to allow the passage of an operative fluid, a support structure and a distributor, wherein the hybrid evaporation module is symmetric with respect to a vertical axis and to a transversal axis both perpendicular to said longitudinal axis.

18 Claims, 3 Drawing Sheets

(56) References Cited

U.S. PATENT DOCUMENTS

| | | | | |
|---|---|---|---|---|
| 6,293,112 | B1 * | 9/2001 | Moeykens | F25B 39/02 62/84 |
| 9,347,715 | B2 * | 5/2016 | Schreiber | F28D 3/02 |
| 9,677,818 | B2 * | 6/2017 | Numata | F28D 7/16 |
| 2011/0017432 | A1 * | 1/2011 | Kulankara | F28F 9/22 62/503 |
| 2017/0153061 | A1 * | 6/2017 | Yoshioka | F28D 3/04 |

FOREIGN PATENT DOCUMENTS

| | | | |
|---|---|---|---|
| EP | 3748272 | A1 | 12/2020 |
| JP | S61192177 | U | 11/1986 |
| WO | WO0055552 | A1 | 9/2000 |
| WO | WO2009089514 | A2 | 7/2009 |
| WO | WO2013074749 | A1 | 5/2013 |
| WO | WO2020034937 | A1 | 2/2020 |

OTHER PUBLICATIONS

International Search Report and Written Opinion issued in connection with International Patent Application No. PCT/IB2022/061341 and dated Jan. 2, 2023, 12 pages.
United States Office Action issued in connection with U.S. Appl. No. 18/712,441 and dated Nov. 25, 2025, 20 pages.
European Office Action issued in connection with EP application No. 22813754.3 dated May 27, 2026, 5 pages.

* cited by examiner

HYBRID EVAPORATOR ASSEMBLY

CROSS-REFERENCE TO RELATED APPLICATIONS

This patent application claims priority from Italian Patent Application No. 102021000030026 filed on Nov. 26, 2021 the entire disclosure of which is incorporated herein by reference.

TECHNICAL FIELD

The present invention concerns an evaporator assembly, in particular a hybrid evaporator assembly.

The present invention finds its preferred, although not exclusive, application in a fluid conditioning circuit such as a conditioning circuit for refrigerating arrangements.

BACKGROUND OF THE INVENTION

Evaporators are used for allowing the passage of a fluid from a liquid phase to a gaseous phases. In conditioning circuits evaporators are used for allowing a refrigerant fluid to pass s from liquid phase to gaseous phases by subtracting heat from another operative fluid passing in the evaporator.

In particular, in almost all arrangement, the evaporator comprises a housing defining a space into which the refrigerant fluid is inserted and forced to pass through a tube bundle that is configured to allow the passage of operative fluid in the aforementioned space for exchanging heat with the refrigerant fluid.

Furthermore, the aforementioned evaporator arrangement may be designed in some known configuration, among which:

- the flooded evaporators, wherein at least part of the tube bundle is sunk in liquid phase of the refrigerant fluid,
- the falling film evaporators, wherein the refrigerant fluid is poured on the tube bundle, or
- the spraying evaporators, wherein the refrigerant fluid is sprayed on the tube bundle.

Another known typology of evaporators is the so-called hybrid evaporator i.e. a combination of flooded evaporators and falling film/spraying evaporators.

Hybrid evaporators are advantageous to increase performances of the evaporator assembly, in general.

However, hybrid evaporators still have a considerable load, i.e. they use a flow of refrigerant fluid that may be further optimized. Moreover, the distribution of the refrigerant fluid highly dependents on the typology of refrigerant fluid.

Accordingly, specific solutions for allowing a uniform distribution of the refrigerant fluid should be proposed, thereby increasing production costs. Conversely, a universal design solution would lead to a not-uniform distribution of the refrigerant fluid.

The not-uniform distribution of refrigerant fluid lead to a decreasing thermal exchange efficiency and increases the possibility that liquid phase evaporator fluid drops may be sucked downstream to the evaporator.

The need of a uniform distribution of refrigerant fluid is furthermore felt because both the outlet sucking conduit of the evaporator and the inlet refrigerant conduit are usually placed inclined with respect to a vertical axis of the evaporator and inclined one with respect to the other.

Such arrangement, needed because of installation requirements space, needs a good refrigerant fluid distribution to avoid drops of liquid phase refrigerant to be sucked by the outlet conduit.

Therefore, the need is felt to improve existing hybrid evaporator assemblies in order to increase their efficiency, in particular by reducing their load ad increasing the distribution of refrigerant fluid within the tube bundle.

An aim of the present invention is to satisfy the above mentioned needs in a cost-effective and optimized manner.

SUMMARY OF THE INVENTION

The aforementioned aim is reached by a hybrid evaporator assembly as claimed in the appended set of claims.

BRIEF DESCRIPTION OF DRAWINGS

For a better understanding of the present invention, a preferred embodiment is described in the following, by way of a non-limiting example, with reference to the attached drawings wherein.

DETAILED DESCRIPTION OF THE INVENTION

Figure 1:
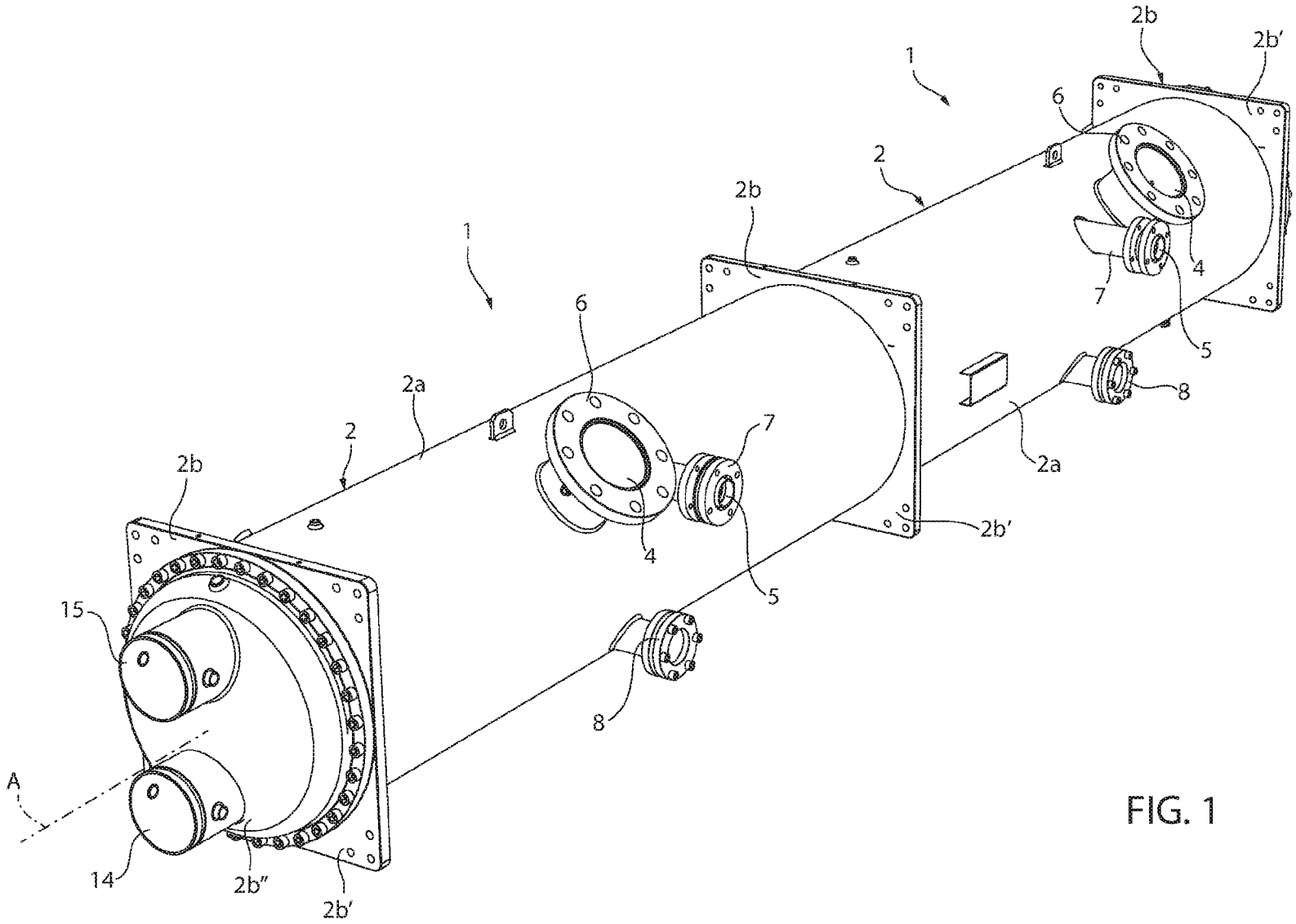
FIG. 1 is a perspective view of an evaporator assembly according to the intention.

In the attached, reference number 1 globally indicates an evaporator assembly 1 according to the invention.

The evaporator assembly 1 comprises a housing 2 defining a closed space 3. The housing 2 comprises an intermediate portion 2*a* and a pair of terminal portion 2*b* configured to be secured to the intermediate portion 2*a*.

Preferably, the intermediate portion 2*a* has a tubular cylindrical shape extending along a longitudinal axis A; terminal portions 2*b* each comprises a perimeter part 2*b*' configured to allow the fixation of the assembly 1 to ground or to support structure of a refrigerant apparatus and a central part 2*b*" configured to mate with the intermediate portion 2*a* to close the space 3. In the disclosed embodiment, the perimeter part 2*b*' has a quadrangular shape.

Accordingly, space 3 has a cylindrical shape along axis A that is radially delimited by intermediate portion 2*a* and axially delimited by central part 2*b*".

The evaporator assembly 1 further defines a first opening 4 and a second opening 5 configured to be coupled to, respectively, an outlet conduit (not shown) and an inlet conduit (not shown) of a refrigeration assembly comprising evaporator assembly 1.

According to the shown embodiment, the first and second openings 4, 5 are defined on respective first and second manifolds 6, 7, i.e. respectively an outlet and an inlet manifolds 6, 7, extending from an outer surface of the intermediate portion 2*a* of the housing 2.

In particular, the first and second manifolds 6, 7 extends along respective axis B and C that are inclined with respect to a vertical axis D perpendicular to longitudinal axis A of the evaporator assembly 1.

In particular, the axis C of second manifold 7 is preferably perpendicular to vertical axis D and to longitudinal axis A while the axis B of first manifold 6 is inclined, i.e. presenting an acute or obtuse angle with respect to axis C or D.

The housing 2 may further define other elements or openings, such as a level viewer 8 not further described into detail.

In the exemplarily shown embodiment two evaporator assemblies 1 are arranged with a common terminal portion 2*b* along longitudinal axis A.

The evaporator assembly 1 comprises a hybrid evaporation module 10 housed within the space 3, the hybrid evaporation module 10 comprises a refrigerant distributor 11, a tube bundle 12 and a support structure 13 for supporting the tube bundle 12 and, preferably, also the refrigerant distributor 11.

The tube bundle 12 comprises a plurality of tubes 12*a*, having preferably the same equivalent diameter; in the disclosed embodiment they are circular and all of the same diameter.

The tubes 12*a* are configured to allow the circulation of an operative fluid between an inlet 14 and an outlet 15, preferably carried by one of terminal portion 2*b*.

In particular the outer tubes 12*a* of the tubes bundle 12, e.g. second, third and fourth tubes groups 12", 12'", 12"", are fluidly connected to inlet 14 while the inner tubes 12*a* of the tube bundle 12, e.g. first tubes group 12' are fluidly connected to outlet 15. According to the above, the outer tubes 12*a* have a greater temperature with respect to the inner tubes 12*a* according to vertical axis D direction.

The inner and outer tubes 12*a* are fluidly connected together to allow the counter flow passage of the fluid contained therein in terminal portion 2*b* opposite to the one housing inlet 14 and outlet 15.

Conversely, in the terminal portion 2*b* housing the inlet 14 and outlet 15 divisor walls may be placed to guide the fluid flow in the correct outer and inner tubes without mixing. An exemplarily embodiment, not further described for sake of brevity, may be found in EP3748270 A1 for sake of example.

In particular, the tubes 12*a* are disposed symmetrically with respect to longitudinal axis A and are vertically placed below the distributor 11.

Advantageously, the support structure 13 comprises a plurality of walls configured to define a space 16 that is vertically delimited on one side and opened towards the bottom of space 3 on the opposite and laterally delimited by the wall of support structure 13. The space 16 has therefore a parallelepiped shape, opened towards the bottom.

The tubes 12*a* of tube bundle 12 are grouped in different tube groups. A first tubes group 12' is housed in an upper portion of space 16, i.e. closer to distributor 11, a second tubes group 12" is housed below the first tubes group 12' and partially extends over space 16 in space 3, a third tubes group 12'" extends in the bottom portion of space 3 and a pair of fourth tubes groups 12"" are placed laterally comprised between the support structure 13 and intermediate portion 2*a* of housing 2 in an upper portion of space 3, i.e. above the half line of the cross-section of the intermediate portion.

Figure 2:
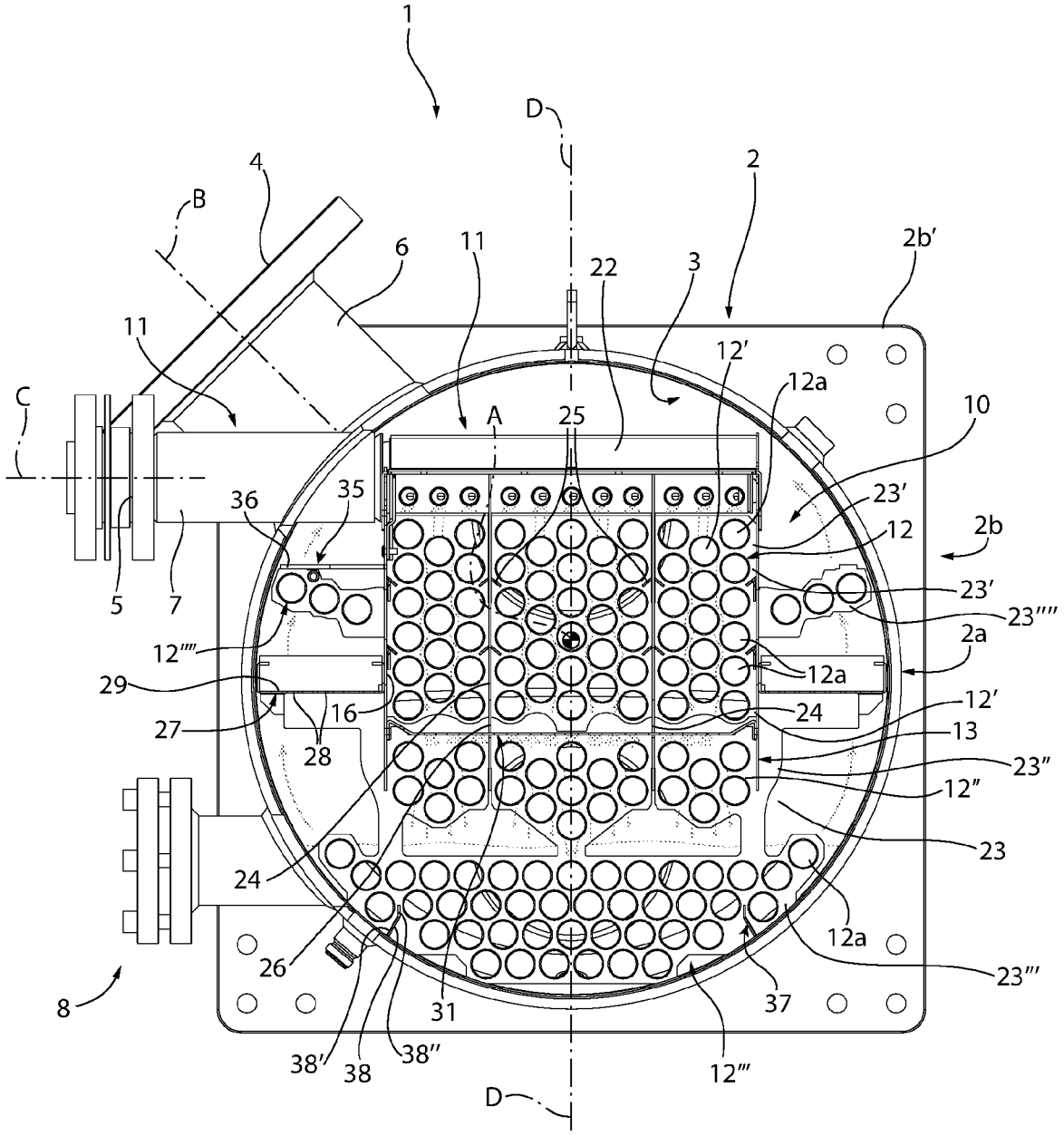
FIG. 2 is a cross-sectional view along a transversal plane with respect to a longitudinal axis of the evaporator assembly of FIG. 1.
Figure 4:
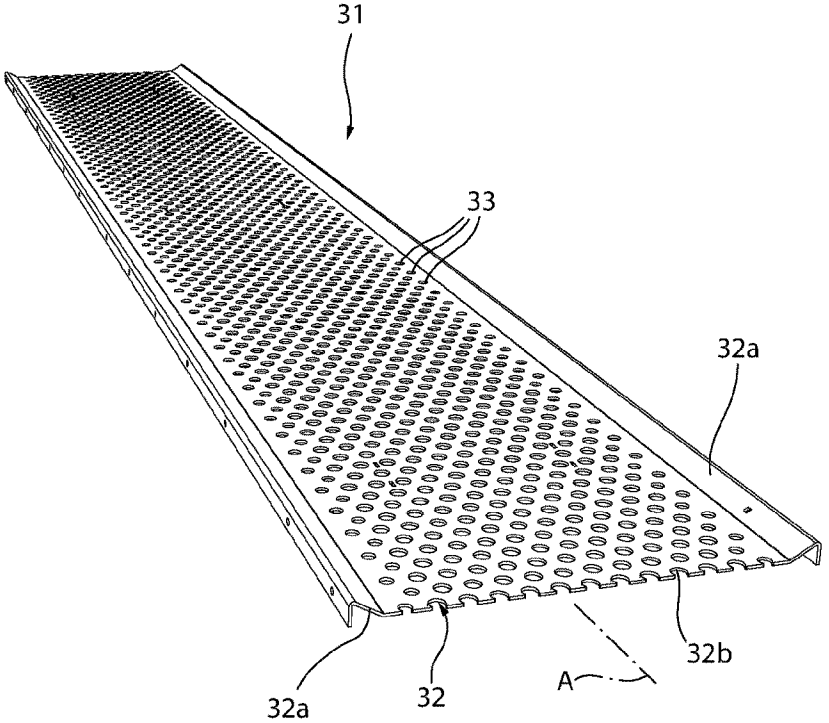
FIG. 4 is a perspective view of an element of the evaporator assembly.

In particularly, as more clear in FIG. 2, the first tubes group 12' has a substantially rectangular distribution in space 3, the second tubes group 12" has a substantially rectangular distribution with a lower edge having variable height in space 3, the third tubes group 12'" has a substantially semicircular distribution in space 3 and the fourth tubes group 12"" has a substantially linear distribution in space 3, preferably, inclined with respect to vertical axis D.

Figure 3:
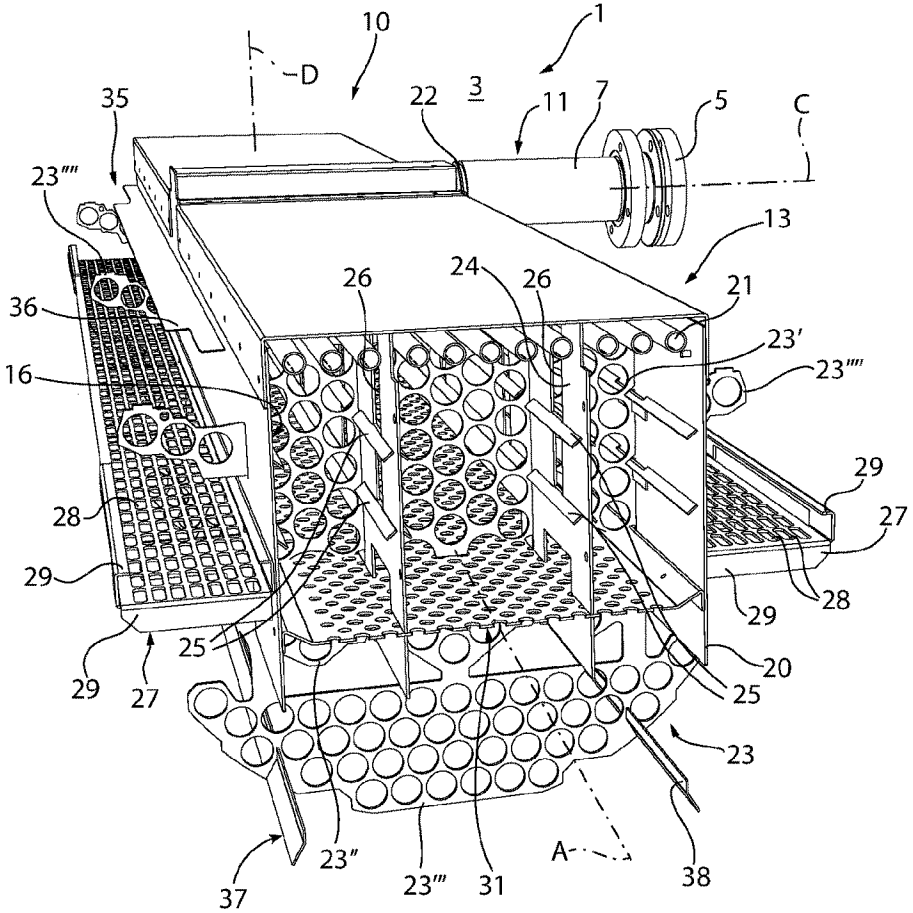
FIG. 3 is a perspective view of an internal portion of the evaporator assembly of FIG. 1 with parts removed for sake of clarity.

Making reference to FIG. 3 for a better visual representation of structure 13 it can be appreciated that structure 13 comprises perimeter walls 20 configured to delimit the space 16. In particular, the perimeter walls 20 comprises a top wall and a pair of lateral walls.

The distributor 11 is configured to be at least partially housed within space 13 and configured to let refrigerant fluid to be dispensed over tube bundle 12.

In particular, the distributor 11 comprises a plurality of distribution tubes 21 fluidly connected to a conduit assembly 22. The conduit 21 is fluidly connected to manifold 7 to allow refrigerant fluid flows within evaporator assembly 1 and is advantageously positioned in correspondence of intermediate portion 2*a* along longitudinal axis A.

In particular, it is noticed that distribution tubes 21 are placed within space 16 and conduit assembly 22 is placed partially through top wall of perimeter walls 20.

The distribution tubes 21 are placed vertically above the tube bundle 12 and are preferably placed in a row along transversal direction with respect to longitudinal axis A, i.e. they are placed at the same height. More preferably, they are displaced at the same transversal distance one with resect to the other, i.e. they are spaced transversally of the same distance.

The support structure 13 further comprises transversal walls 23 provided with a plurality of openings 24, such openings 24 are designed to house tubes 12*a* of the tube bundle 12 in order to provide to this latter support/guide along space 3.

According to the above described topology of the tubes 12*a* of tube bundle 12, the support structure 13 comprises a plurality of first transversal walls 23' to support/guide first tubes group 12', a plurality of second transversal walls 23" to support/guide second tubes group 12", a plurality of third transversal walls 23'" to support/guide first tubes group 12'" and a plurality of fourth transversal walls 23"" to support/guide first tubes group 12"".

The support structure 13 further comprises at least a longitudinal wall 24 extending parallel to longitudinal axis A in order to transversally subdivide space 16. In the described example, the support structure 13 comprises a pair of longitudinal walls 24 that divides space 16 into a pair of lateral portions that have the same transversal extension and a central portion that has a greater transversal extension with respect to lateral portions.

Preferably, longitudinal walls 24, and in case, lateral portion of perimeter wall 20, are provided with cantilevered walls 25 extending transversally from the longitudinal wall 24 inclined towards bottom portion of space 3 with respect to vertical axis D.

In the disclosed embodiment each longitudinal wall 24 and the lateral portion of perimeter wall 20 comprises a pair of cantilevered walls 25 that are vertically equally spaced one with respect to the other, i.e. they are placed in two rows. In particular, both sides of a longitudinal wall 24 is provided with cantilevered walls 25.

Preferably, longitudinal walls 24 are provided with openings 26 to allow fluidic communication between the above described portions of space 16.

The hybrid evaporation module further comprises a demister mesh 27 that is preferably carried by the support structure 13.

In particular, the demister mesh 27 is vertically placed between the bottom of the space 3 and the fourth tubes group 12"" and carried by perimeter wall outside space 16, i.e. radially comprised between the perimeter wall 20 and intermediate portion 2*a* of housing 2.

The demister mesh 27 defines a plurality of openings 28 disposed into a web and configured to avoid the passage of drops from the bottom portion of space 3 and the first manifold 6.

Advantageously, the demister mesh 27 comprises sealing walls 29 extending vertically, i.e. along vertical axis D and configured to cooperate by contact with perimeter wall 20 and the inner surface of the intermediate proton 2*a* in order to allow fluidic communication only through the demister mesh 27.

The aforementioned walls may be realized separately and fixed together or being realized, at least some among them, as one piece The hybrid evaporation module 10 further comprises a distributor plenum 31 vertically interposed within the tube bundle 12 and configured to distribute refrigerant fluid along said vertical axis D direction.

In particular, the distributor plenum 31 is housed within space 16 and vertically comprises between the first and second tubes groups 12', 12" and laterally in contact with perimeter wall 20 so that refrigerant fluid is forced to pass through the distributor plenum 31.

Distributor plenum 31 comprises a plate element 32 extending along axis A and provided with a pair of lateral portion 32*a* with respect to longitudinal axis A and a central portion 32*b* laterally comprised by lateral portion 32*a*.

The central portion 32*b* is provided with a mesh of openings 33 distributed along all the area of the central portion 32*b*.

Advantageously, such openings 33 may have different diameters or may be distances with variable distances in function of the distance of the opening 33 with respect to outlet opening 4 in order to allow uniform distribution of the refrigerant fluid in counter action to the sucking pressure coming from outlet opening.

Accordingly, openings 33 that are nearer to the opening 4 may be smaller in diameter or have less density (i.e. they can be more distanced one with respect to the other) with respect to openings 33 that are more distant with respect to opening 4.

The lateral portions 32*a* have advantageously the same shape, i.e. they have a vertically variable profile configured to collect refrigerant fluid towards the central portion 32*b*. In particular, the variable profile is a linear profile that has the greatest height along vertical axis D in contact to perimeter wall 20 decreasing linearly till reaching the height of the central portion 32*b*.

The hybrid evaporation module 10 further comprises oil separation means 37 configured to improve oil separation with respect to the refrigerant fluid flow.

In particular, such oil separation means 37 comprises a pair of longitudinal walls 38 extending on at least part, preferably entirely, on the longitudinal axis direction within intermediate portion 2*a* of housing 2. Preferably, walls 38 are two and placed on opposite sides with respect to axis D, more preferably at the same distance thereof.

As exemplarily shown, the walls 38 are placed within the third tubes group 12'" and extends from a lower portion of the intermediate portion 2*a*. In particular, the walls 38 each comprise a lower portion that extends radially with respect to the lower surface of intermediate portion 2*a* and an upper portion 38" that extends from the lower portion 38' in a direction parallel to vertical axis D.

It is furthermore noticed that the structure of the hybrid evaporation module 10 is symmetric with respect to vertical axis D and with respect to longitudinal axis A, i.e. the half of hybrid evaporation module 10 on the left with respect to vertical axis D is equal to the right half and the half of hybrid evaporation module 10 on the rear with respect to longitudinal axis A is equal to the front half.

The hybrid evaporation module 10 may further comprises ventilation plate 35 arranged within space 3 in proximity of first manifold 6 and configured to avoid direct sucking of the gaseous phase refrigerant flow from this latter, i.e. it forces the passage of refrigerant flow about the ventilation plate 35 before reaching the first manifold 6.

In greater detail, the ventilation plate 35 comprises a wall 36 that extends parallel to axis C direction from support structure 13 within space 3. In particular, the wall 36 extends perpendicularly from lateral walls of perimeter walls 30 above the fourth tubes group 12"", i.e. just beneath the top portion of perimeter wall.

Preferably, the wall 36 has a variable length profile in the transversal direction of axis C, wherein the maximum transversal extension is in proximity of the first manifold 6 and the minimum extension is in the terminal longitudinal portions of the wall 36.

The operation of the above described hybrid assembly 1 is the following.

Making reference to FIG. 2, it is noticed that, summarizing, refrigerant fluid passes from conduit assembly 22 towards distribution conduits 21, through tube bundle 12 and evaporates; such gaseous phase of refrigerant fluid is sucked by outlet manifold 7.

In greater detail, distribution conduits 22 flow the refrigerant fluid above the tube bundle 12. The refrigerant fluid is uniformly distributed on the upper tubes 12*a* and flows down tube by tube. During the passage through the tube bundle 12, it exchange heat through the external surface of tubes 12*a* with the operative fluid flowing therein, cooling this latter. The refrigerant fluid then collects in lower portion of space 3 flooding the lowest tubes 12*a* and continuing to exchange heat which this latter.

During the passage in the tube bundle 12, the cantilevered portions 25 help to avoid that refrigerant fluid tends to flow on longitudinal walls 24 or in perimeter walls 20. The same longitudinal walls 24 avoid that too much refrigerant fluid passes between central portion of space 16 and lateral portions of space 16.

The distribution plenum 31 further optimizes the refrigerant flow distribution, in particular avoiding an excessive flow passage in proximity of outlet manifold 7.

When evaporating, the gaseous phase refrigerant passes through the demister mesh 27, thereby reducing possibility that liquid phase refrigerant may flow towards outlet manifold 7.

Following to the above passage, the gaseous phase refrigerant passes through the forth tubes group 12"" thereby overheating and further avoiding that liquid phase refrigerant may flow towards the outlet manifold.

According to the above, it is clear that refrigerant fluid is evaporated and overheated thanks to the hybrid evaporation module 10.

In view of the foregoing, the advantages of an evaporator assembly 1 according to the invention are apparent.

The presence of the falling flow of refrigerant on tube bundle, optimized thanks to the different elements of the hybrid evaporation module 10 allows to reduce the refrigerant load, thereby increasing the efficiency of the evaporator assembly.

The presence of the demister mesh combined with the perimeter walls clearly divides the liquid-phase portion of space 3 with respect to the gaseous phase portion of space 3, thereby avoiding passage of fluid to outlet manifold 7.

The presence of the flooded portion in the bottom portion of space 3 allows to evaporate all refrigerant fluid and to provide a reservoir of refrigerant fluid for operational necessities.

The symmetric layout of hybrid evaporation module 10 improves the space optimization of the hybrid evaporation module 10 allowing a reduction of space an weight. Moreover, the symmetric layout improves the fluid distribution and the evaporated fluid suction.

The fact that the inlet and outlet manifolds 6, 7 are realized laterally with respect to vertical axis of the evaporator assembly 1 facilitates the installation with other elements of the refrigeration assembly.

The presence of the mesh demister interposed between the inner surface of the housing 2 and the perimeter wall 20, allows to delimit the above mentioned liquid-gaseous phase portion of space 3, avoiding liquid passage towards outlet manifold.

The presence of fourth tubes group 12"" allows to overheat evaporated gas before suction by outlet conduit, further reducing the possibility of suction of liquid refrigerant.

The ventilation plate 35 further avoid the liquid suction by making uniform the suction flow coming from outlet conduit, thereby improving evaporator gaseous flows towards this latter.

The presence of plenum 31 allows to uniform the distribution of refrigerant liquid flow coming from a portion of the tube bundle, in particular avoiding a preference of direction in proximity to outlet conduit.

In particular, the fact that plenum 31 is placed inside the space 16 delimited by structure 13 forces the liquid to fall within the flooded portion so that cannot pass directly to outlet conduit.

It is clear that modifications can be made to the described evaporator assembly 1 which do not extend beyond the scope of protection defined by the claims.

For example, the tube bundle 12 may have a different topology of tubes 12*a* that may have different shapes. Similar consideration may apply to distribution conduits 21.

Similarly, support structure 13 may have a different shape and/or its elements may be realized with different geometries or realized in many or single pieces connected among them.

The described openings in some elements may have different geometry or distribution with respect to the shown one.

In general, housing 2 may have a different shape and more evaporator assembly 1 can be linearly coupled as show in the attached drawings.

The invention claimed is:

1. Evaporator assembly for evaporating a refrigerant fluid of a refrigerant arrangement, said evaporator assembly comprising a housing defining a first space extending along a longitudinal axis, said evaporator comprising an inlet manifold configured to allow the insertion of said refrigerant fluid in liquid state and an outlet manifold configured to allow the suction of said refrigerant fluid in gaseous state, said outlet and inlet manifolds being disposed inclined with respect to a vertical axis of said evaporator assembly perpendicular to said longitudinal axis, said evaporator assembly comprising a hybrid evaporation module housed within said first space and comprising a tube bundle provided with a plurality of tubes configured to allow the passage of an operative fluid, a support structure, and a distributor, wherein said support structure defines a second space housing at least part of said plurality of tubes, wherein said distributor comprises a conduit assembly at least partially housed within said second space and passing through said inlet manifold and extending along a transversal axis perpendicular to said longitudinal and vertical axes, said distributor further comprises a plurality of distribution conduits housed within said second space and extending along said longitudinal axis from said conduit assembly and provided with openings to distribute liquid refrigerant fluid above said tube bundle, wherein said hybrid evaporation module is symmetric with respect to said vertical axis and to said transversal axis, said support structure comprises perimeter walls defining a quadrangular shape, said perimeter walls defining said second space opened towards to the bottom of said second space according to said vertical axis, said tube bundle comprising a first tubes group housed within said second space, a second tubes group partially housed within said second space, and a third tubes group housed in said bottom of said first space.

2. Evaporator assembly according to claim 1, wherein said support structure comprising transversal walls housed within said second space and extending parallel to said transversal axis direction, said transversal walls being provided with openings to house said plurality of tubes.

3. Evaporator assembly according to claim 1, wherein said support structure comprising longitudinal walls housed within said second space and extending parallel to said longitudinal axis direction, said longitudinal walls dividing said second space in a plurality of portions.

4. Evaporator assembly according to claim 3, wherein said longitudinal walls define at least one openings to allow the fluidic communication between said portions of said second space.

5. Evaporator assembly according to claim 1, wherein said perimeter walls and/or longitudinal walls comprises cantilevered walls extending from said perimeter walls and/or said longitudinal walls inclined towards said bottom of said first space.

6. Evaporator assembly according to claim 1, wherein said hybrid evaporation module comprises a demister mesh housed within said first space and cooperating between said housing and said support structure, said demister mesh dividing said first space in a portion wherein said refrigerant fluid is in liquid phase comprising said second space and a portion wherein said refrigerant fluid is in gaseous phase and in fluid communication with said outlet manifold.

7. Evaporator assembly according to claim 6, wherein said demister mesh comprises sealing walls configured to cooperate at contact with said support structure and said housing to avoid passage of said liquid phase refrigerant fluid.

8. Evaporator assembly according to claim 6, wherein said demister mesh is part of said support structure.

9. Evaporator according to claim 1, wherein said tube bundle comprises a fourth tubes group extending in an upper portion of said first space outside form said second space defined by said support structure, said fourth tubes group being configured to overheat said gaseous state refrigerant fluid passing through themselves.

10. Evaporator assembly according to claim 9, wherein said hybrid evaporation module comprises a demister mesh housed within said first space and cooperating between said housing and said support structure, said demister mesh dividing said first space in a portion wherein said refrigerant fluid is in liquid phase comprising said first space and a portion wherein said refrigerant fluid is in gaseous phase and in fluid communication with said outlet manifold, and wherein said fourth tubes group is vertically placed above said demister mesh.

11. Evaporator assembly according to claim 9, wherein said fourth tubes group is carried by said support structure.

12. Evaporator assembly according to claim 1, wherein said hybrid evaporation module comprises a ventilation plate arranged within said first space and carried by said support structure in proximity of said outlet manifold, said ventilation plate forcing a flow of gaseous phase refrigerant flow to pass around this latter to reach said outlet manifold.

13. Evaporator assembly according to claim 12, wherein said ventilation plate comprises a wall extending parallel to said transversal axis direction from said support structure.

14. Evaporator assembly according to claim 1, wherein said hybrid evaporation module comprises a distributor plenum housed within said second space within said at least part of said tube bundle, said distributor plenum being configured to force the passage of said liquid refrigerant along a vertical axis direction.

15. Evaporator assembly according to claim 14, wherein said plenum comprises a plate extending along said longitudinal axis, said plate comprising a pair of lateral portions cooperating at contact with said support structure and a central portion provided with a plurality of openings.

16. Evaporator assembly according to claim 14, wherein said openings vary their dimension or their density in said central portion in proximity to said outlet manifold.

17. Evaporator assembly according to claim 1, wherein said hybrid evaporation module comprises an oil separation means housed within said third tubes group and configured to improve oil separation with respect to refrigerant fluid, said oil separation means comprising a pair of walls symmetrically placed with respect to said vertical axis and extending from a bottom surface of said housing towards said third tubes group.

18. Evaporator assembly for evaporating a refrigerant fluid of a refrigerant arrangement, said evaporator assembly comprising a housing defining a first space extending along a longitudinal axis, said evaporator comprising an inlet manifold configured to allow the insertion of said refrigerant fluid in liquid state and an outlet manifold configured to allow the suction of said refrigerant fluid in gaseous state, said inlet and outlet manifolds being disposed inclined with respect to a vertical axis of said evaporator assembly perpendicular to said longitudinal axis, said evaporator assembly comprising a hybrid evaporation module housed within said first space and comprising a tube bundle provided with a plurality of tubes configured to allow the passage of an operative fluid, a support structure, and a distributor, wherein said support structure defines a second space housing at least part of said plurality of tubes, wherein said distributor comprises a conduit assembly at least partially housed within said second space and passing through said inlet manifold and extending along a transversal axis perpendicular to said longitudinal and vertical axes, said distributor further comprises a plurality of distribution conduits housed within said second space and extending along said longitudinal axis from said conduit assembly and provided with openings to distribute liquid refrigerant fluid above said tube bundle, wherein said hybrid evaporation module comprises a distributor plenum carried by said support structure within said second space and vertically interposed along said vertical axis, said distributor plenum being configured to force the passage of said liquid refrigerant along a vertical axis direction, wherein said distributor plenum comprises a plate extending along said longitudinal axis that includes a central portion provided with a plurality of openings, and said openings vary their dimension or their density in said central portion in proximity to said outlet manifold.

* * * * *